US010242656B2

(12) United States Patent
Sartre et al.

(10) Patent No.: US 10,242,656 B2
(45) Date of Patent: Mar. 26, 2019

(54) ULTRASOUND TRANSDUCER

(71) Applicant: AREVA NP, Courbevoie (FR)

(72) Inventors: Bernard Sartre, Saint-Remy (FR); Jean-François Saillant, Chalon sur Saone (FR)

(73) Assignee: AREVA NP, Courbevoie (FR)

( * ) Notice: Subject to any disclaimer, the term of this patent is extended or adjusted under 35 U.S.C. 154(b) by 570 days.

(21) Appl. No.: 14/901,019

(22) PCT Filed: Jun. 27, 2014

(86) PCT No.: PCT/EP2014/063729

§ 371 (c)(1),
(2) Date: Dec. 22, 2015

(87) PCT Pub. No.: WO2014/207215

PCT Pub. Date: Dec. 31, 2014

(65) Prior Publication Data

US 2017/0323626 A1 Nov. 9, 2017

(30) Foreign Application Priority Data

Jun. 27, 2013 (FR) ..... 13 56193

(51) Int. Cl.
*G10K 11/00* (2006.01)
*G10K 11/04* (2006.01)
(Continued)

(52) U.S. Cl.
CPC ..... *G10K 11/002* (2013.01); *G10K 11/004* (2013.01); *G10K 11/20* (2013.01);
(Continued)

(58) Field of Classification Search
CPC ..... G10K 11/002; G10K 11/20
(Continued)

(56) References Cited

U.S. PATENT DOCUMENTS 3,054,084 A 9/1962 Parssinen et al.
3,234,413 A * 2/1966 Schwartz ..... H01L 37/02 136/205

(Continued)

FOREIGN PATENT DOCUMENTS

EP 0095383 A2 11/1983
EP 0 147 070 A2 7/1985

(Continued)

OTHER PUBLICATIONS

Search Report for corresponding International Application PCT/EP2014/063729.

*Primary Examiner* — Thomas M Dougherty
(74) *Attorney, Agent, or Firm* — Davidson, Davidson & Kappel, LLC

(57) ABSTRACT

An ultrasound transducer is provided. The ultrasound transducer include at least one emitter made from a piezoelectric material, having first and second emitting surfaces opposite one another provided to emit first and second ultrasound beams. The transducer comprises at least first and second mirrors placed across from the first and second emitting surfaces, respectively, and configured so as to deflect back the first and second ultrasound beams by forming a reflected beam with a predetermined shape.

17 Claims, 4 Drawing Sheets

(51) Int. Cl.
*G10K 11/20* (2006.01)
*G10K 11/34* (2006.01)
*H04R 17/00* (2006.01)

(52) U.S. Cl.
CPC ..... *G10K 11/04* (2013.01); *G10K 11/34* (2013.01); *H04R 17/005* (2013.01)

(58) Field of Classification Search
USPC ..... 310/322, 334
See application file for complete search history.

(56) References Cited

U.S. PATENT DOCUMENTS 3,243,768 A * 3/1966 Roshon, Jr. ..... B06B 1/0607 310/335
3,325,779 A 6/1967 Supernaw et al.
3,509,522 A 4/1970 Whitfill
3,703,652 A * 11/1972 Noda ..... H04R 1/345 310/335
4,096,756 A * 6/1978 Alphonse ..... B06B 1/0614 310/317
4,241,432 A * 12/1980 Barber ..... G10K 11/20 367/151
4,314,098 A 2/1982 Maerfeld
4,332,016 A 5/1982 Bernsten
4,495,817 A 1/1985 Hunt et al.
4,825,116 A * 4/1989 Itoh ..... B06B 1/0688 310/326
5,174,280 A * 12/1992 Gruenwald ..... G10K 9/12 367/175
5,577,506 A * 11/1996 Dias ..... A61B 8/12 310/366
7,564,986 B2 * 7/2009 Sekino ..... B06B 1/0292 381/160
2002/0071280 A1 6/2002 Stahl et al.
2005/0264902 A1 12/2005 Rennick et al.
2008/0007142 A1 * 1/2008 Toda ..... G10K 11/28 310/335
2008/0223953 A1 9/2008 Akira

FOREIGN PATENT DOCUMENTS

JP S5748894 A 3/1982
JP S5940846 A 3/1984
JP 2002118896 A 4/2002
JP 2008-100204 A 5/2008
JP 2008100204 A 5/2008
JP 201229083 A * 2/2012 ..... G10K 11/26
JP 201229106 A * 2/2012 ..... H04R 3/00

* cited by examiner

ULTRASOUND TRANSDUCER

The invention relates in general to ultrasound transducers.

More specifically, the invention relates to an ultrasound transducer comprising at least one emitter made from a material that makes it possible to convert an electrical signal into an ultrasonic wave, having first and second emitting surfaces opposite one another provided to emit first and second ultrasound beams.

BACKGROUND

Such a transducer is known from EP 0 147 070, which discloses that one of two emitting surface is covered with a damping material, also known by the term backing, which is used to dampen the vibration of the material constituting the emitter and to trap the acoustic energy emitted by the rear surface of the emitter, in a manner such that it does not disrupt the useful beam emitted by the front surface.

SUMMARY OF THE INVENTION

Such a transducer has a relatively high cost of production, because it makes use of a large number of different materials. Moreover, only a part of the acoustic energy produced by the vibration of the emitter is used, the other part being dissipated into the dampener.

In this context, an ultrasound transducer is provided that is less expensive and more efficient in terms of energy conversion.

To this end, the invention provides an ultrasound transducer of the aforementioned type, characterised in that it comprises at least first and second mirrors placed so as to be across from the first and second emitting surfaces, respectively, and configured in a manner such as to deflect back the first and second ultrasound beams by forming a reflected beam with a predetermined shape.

Thus, the ultrasound beams emitted by two opposite emitting surfaces are used, in a manner such that, for a given electrical power being supplied to the emitter, the energy of the beam produced by the ultrasound transducer is significantly higher.

Due to the fact that all of the acoustic energy emitted by the emitter is concentrated in the reflected ultrasound beam, it is possible to obtain an enhanced degree of sensitivity for the ultrasound transducer for the same level of electrical energy supplied to the emitter.

On the other hand, it is no longer necessary to provide a backing against one of the two emitting surfaces, such that the design of the ultrasound transducer is greatly simplified. The fabrication of the transducer is therefore simpler, with its production cost being thereby reduced.

The reproducibility of the sensors is thus enhanced. The significance thereof is that the performance aspects are consistent and more uniform from one sensor to another. Indeed, in the state of the art, the bonding of the backing material on to the rear surface of the emitter is a delicate operation. Depending on the quality of the bonding, the properties of the transducer will accordingly be affected.

The transducer according to embodiments of the invention is indeed highly appropriate for operating in a harsh environment. It presents a favourable temperature behaviour, on account of the fact that it no longer includes a plurality of sizable layers stacked one on top of the other as in the state of the art. The risks of failure of the transducer as a result of the constraints caused by the differential expansion of materials is thus reduced.

The transducer presents a good ability to withstand pressure, due to the fact that the backing has been removed. The backing is usually made out of an elastomeric material, and therefore presents good pressure resistance at moderate pressure.

The transducer according to embodiments of the invention is indeed highly appropriate for operating under irradiation conditions. Indeed, it is possible for it to be fabricated entirely without any elastomeric material. In the context of the state of the art, the backing is made out of an elastomeric material.

The emitter is typically made from a piezoelectric crystal. By way of a variant, the emitter is made out of an electrostrictive or magnetostrictive material, or any other material that is capable of converting an electrical signal into an ultrasonic wave.

Here the term emitter is used to refer to an active element of the transducer whose function is to convert the electrical energy into mechanical energy. This active element is reversible. It is capable of emitting ultrasonic waves, but also of receiving ultrasonic waves and converting them into an electrical signal. In other words, the transducer can function at certain times as an ultrasound generator and at other times as an ultrasound receiver of, in collector mode.

Advantageously, the transducer includes a housing box to which the emitter is attached.

The housing box has two reflective surfaces defining the first and second mirrors, or the first and second mirrors are attached on to the housing box.

In the first case, the design of the transducer is simplified, since it is the housing box itself which constitutes the mirrors, because they are not additional attached parts.

The housing box is for example a unit made out of stainless steel. By way of a variant, the housing box is made out of another metal alloy or from a ceramic material. The material in any event is chosen in a manner so as to present a high acoustic impedance, that is to say, a high coefficient of reflection with water. Alternatively, it is chosen in such a manner as to present high speeds of sound propagation, so that for a given mirror angle, the critical angle of the longitudinal wave and that of the transverse wave are exceeded (Snell-Descartes law). For example, in the case of a stainless steel mirror and a propagation medium in water, the two critical angles are approximately at 15° and 28°, respectively. In this case, no bulk wave may be transmitted in a mirror above 28°.

The first and second ultrasound beams are reflected directly on the first and second mirrors.

By way of a variant, the first and second mirrors are attached on to the housing box. In this case, the mirrors are made out of stainless steel or another metal alloy or a ceramic material, and present either a high acoustic impedance or a high sound propagation speed, as has been described here above.

Advantageously, the housing box has a slot in which the emitter is engaged, the slot having a cross section that is substantially identical to that of the emitter.

Thus, the emitter is held in position in relation to the housing box by means of a portion of the said emitter, which is locked in place in the slot. The said portion of the emitter is applied directly against the peripheral edge of the slot. The emitter is bonded to the slot or engaged by being force-fitted or clamped into the slot. By way of a variant, a protective layer is interposed between the said portion and the peripheral edge of the slot.

Advantageously, the housing box is integrally formed as a single piece or comprises of two half housing boxes encasing the emitter therebetween.

Each half housing box defines one of the first and second mirrors, or the first mirror is attached on to one of the two half housing boxes and the second mirror is attached on to the other of the two half housing boxes.

Thus, the housing box is particularly economical. When it comprises of two half housing boxes, the mounting of the emitter is simplified.

The slot is provided in the body mass of the housing box when the latter is integrally formed as a single piece. By way of a variant, it is delimited between the two half housing boxes.

Advantageously, the transducer is immersed in an ambient medium, with the first and second emitting surfaces being arranged in relation to the housing box in order to ensure that the first and second ultrasound beams are propagated from the first and second emitting surfaces right up to the first and second mirrors through the ambient medium or through a material constituting the housing box.

In the first case, the transducer is particularly well adapted for a use wherein the reflected beam is transmitted by the ambient medium right to the component piece in which the ultrasonic wave is transmitted. The ambient medium is for example water or another liquid or gaseous fluid.

In the second case, the transducer is indeed capable of sending the reflected beam directly into the component piece in which it is desired to transmit the ultrasonic wave, without the transmission taking place through the ambient medium. The first and second emitting surfaces of the emitter are then pressed flat against the wave input surfaces of the housing box. The wave output surfaces of the housing box are pressed flat against the piece in which the ultrasonic wave is transmitted, directly or indirectly. The first and second mirrors, the input surfaces and the output surfaces are arranged in order to ensure that the first and second ultrasound beams penetrating into the housing box through the input surfaces are reflected by the first and second mirrors right to the output surfaces. The reflected beam exits the housing box through the output surfaces and penetrates into the piece in which the ultrasonic wave is transmitted.

The housing box may then be integrally formed as a single piece or comprises of two half housing boxes that encase the emitter surfaces, each a half housing box defining one of the first and second mirrors.

Advantageously, the transducer includes electrical wires that are able to be connected to a voltage source, and a clamping member that clamps the electrical wires against the emitter in a manner so as to secure the electrical wiring to the emitter without soldering.

In other words, due to the fact that none of the two opposite surfaces of the emitter is covered by a backing, it is possible to place the electrical wires in contact against the emitter. This makes it possible to facilitate the fabrication of the transducer, as it is no longer necessary to solder the electrical wires on to the emitter.

Advantageously the securing is carried out for example by making use of a clamp. This clamp has two arms, biased against two surfaces of the emitter positioned to be opposite one another. The electrical wires are clamped between the arms and the emitter. For example, the transducer comprises of two electrical wires, one of the electrical wires being clamped against one of the surfaces, and the other electrical wire being clamped against the opposite surface.

By way of a variant, these electrical wires are soldered on, placed in contact or secured by any other means.

Typically, the emitter has one active part defining the first and second emitting surfaces and one part that is connected to the electrical wires, with the portion of the emitter that is engaged in the slot being located between the active part and the connection part.

Advantageously, the transducer includes a protective layer covering the first and second emitting surfaces. Such a protective layer provides the ability to protect the piezoelectric material. Indeed, the emitter is arranged in a manner such that it forms a protrusion projecting out from the housing box, and therefore is at risk of being damaged by shocks. The use of a protective layer makes it possible to reduce this risk. Typically, the protective layer covers the entire external surface of the emitter, with the exception of the zones on which the electrical wires are clamped or connected.

The protective layer is made out of an elastomeric material, or a metallic material or a ceramic material. For example, for a transducer designed for the control of a nuclear reactor vessel, the material selected has an acoustic impedance and thickness that allow for the optimal transmission of acoustic energy.

According to a first embodiment, the first and second ultrasound beams present first and second directions of propagation from the first and second emitting surfaces, the first and second mirrors being planar and having first and second normals forming an angle comprised between 30° and 60° in relation to the first and second directions of propagation.

Preferably, the angle is comprised between 40° and 50°, and typically measures 45°. The first and second mirrors are turned in a manner so as to reflect the first and second ultrasound beams in the same direction, corresponding to the central axis of the reflected beam. When the angle is 45°, the reflected beam is a straight beam, with a planar wave front.

Typically, the first and second directions of propagation from the emitting surfaces are aligned and opposite each other. The first and second mirrors form an angle of 90° in relation to each other. By way of a variant, the first and second emitting surfaces are not strictly parallel to each other and form a non-null angle between them, for example an angle of a few degrees.

According to a second embodiment, the first and second mirrors are concave to the first and second emitting surfaces. Such an arrangement makes it possible to generate a concentric wave front, and therefore a focused reflected beam.

According to a third embodiment, the first and second mirrors are convex to the first and second emitting surfaces. Such an arrangement makes it possible to generate a diverging wave front, and therefore a very open beam.

The emitter may be present in any type of form.

Advantageously, the emitter is a plate, with the first and second emitting surfaces being two large parallel surfaces of the plate that are positioned opposite one other.

In this case, the emitting surfaces are typically planar.

Alternatively, the emitter is a cylinder or a tube the axis of which is combined with that of the mirror, with the emitting surfaces being one or more surfaces of revolution that are diametrically opposed.

Typically, the cylinder or the tube has a circular cross section that is perpendicular to its centerline. By way of a variant, the cylinder or the tube has a cross section that is oval, elliptical or of any other shape.

Typically, the first and second emitting surfaces together cover the totality of the periphery of the emitter. Each emitting surface therefore has the shape of a semi cylinder.

In this case, the first and second mirrors together define a frusto-conical or tapered surface, having the same axis as the emitter.

According to another aspect of the invention, the transducer includes at least one sensor provided in order to measure the shape and intensity of the ultrasonic waves, arranged in one of the first and second mirrors.

Due to the fact that the sensor is arranged in one of the first and second mirrors, it can measure the shape or intensity of the waves generated by the transducer without disrupting the ultrasonic beam.

In fact, in known applications, such a sensor is placed at a distance from the transducer, in the ultrasonic beam generated by it. The sensor thus disrupts this ultrasonic beam. It cannot be placed permanently in this beam.

The sensor, used for applications under water, is referred to as the hydrophone.

The transducer may include a single sensor arranged in one of the two mirrors. By way of a variant, it may present one sensor in each of the two mirrors, or even multiple sensors arranged at multiple points of each of the two mirrors.

Advantageously, the first and second mirrors present first and second reflective surfaces, the sensor comprising a head that is positioned to be flush with one of the first and second reflective surfaces.

Thus, the presence of the sensor does not create any reliefs on the reflective surfaces, and does not interfere with the reflection of ultrasonic beams.

The sensors are typically of small sizes, with regard to the surface of the first and second mirrors. Their heads are placed in channels opening out on to the reflective surfaces arranged in the first and second mirrors. They have an external surface that form an integral part of the continuity of the first or the second reflecting surface.

Typically, the head of the sensor is a piezoelectric material. It is electrically connected to a member that makes it possible to record and analyse the electrical voltage from originating from the piezoelectric crystal.

By way of a variant, the sensor includes a thin layer of a material that makes it possible to convert an ultrasonic wave into electrical voltage, for example a piezoelectric material, covering one of the first and second mirrors.

This thin layer typically covers the entire surface of the first or the second mirror. The sensor then includes a plurality of electrodes, each connected to one point of the thin layer, which provides the ability to control several zones of the beam. Each electrode is connected to a member that makes it possible to record and analyse the electrical voltage emitted by the material converter.

BRIEF SUMMARY OF THE DRAWINGS

Other features and advantages of the invention will emerge from a detailed description which is provided here below, purely on an indicative basis and without any limitation, in reference to the annexed figures, among which.

DETAILED DESCRIPTION

Figure 1:
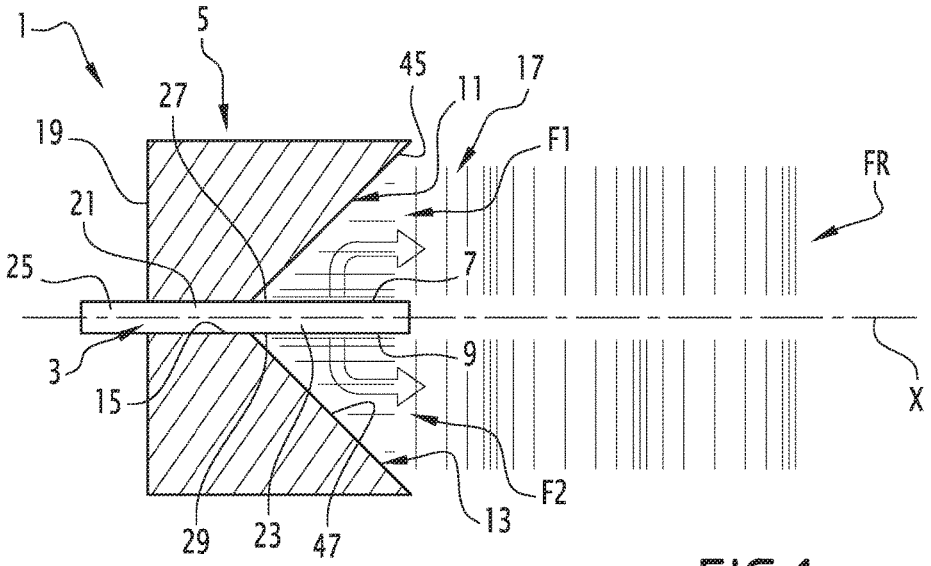
FIG. 1 is a simplified schematic representation of a transducer that is in conformity with an embodiment of the invention.

The ultrasound transducer 1 represented in FIG. 1 is intended to be used in a fluid, for example under water. It is intended for example for use in carrying out the inspection of the pressurised water reactor vessel during the unit outages. It may also be mounted permanently on the pressurised water reactor vessel, for performing measurements of temperature and/or flow rate. It may even be used for the inspection of internal equipment within the reactors where the heat transfer fluid is sodium, or for performing physical measurements (temperature, flow rate) on these same reactors. It may also be used in the medical or therapeutic field, for marine SONAR application, as position sensor or metrology sensor in all kinds of applications, or even for the cleaning of parts.

The transducer 1, as is visible in FIG. 1, includes an emitter 3 made out of a material that makes it possible to convert an electrical voltage into an ultrasonic wave, and a housing box 5.

The emitter 3 presents first and second emitting surfaces 7, 9 located opposite one another, provided in order to emit first and second ultrasound beams F1 and F2.

The housing box 5 defines the first and second mirrors 11, 13, placed so as to be across from the first and second emitting surfaces 7, 9 respectively.

The first and second mirrors 11, 13 are configured formwise in a manner such as to deflect back the first and second ultrasound beams by forming a reflected beam FR with a predetermined shape.

The housing box 5 is made out of stainless steel. It has a slot 15 in which the emitter 3 is engaged.

The two mirrors 11 and 13 are arranged on one front surface of the housing box 5. It delimits together a hollow zone 17 on this front face. More precisely, the first and second mirrors 11 and 13 are two planar surfaces converging towards each other. As is visible in FIG. 1, the slot 3 defines the bottom of the hollow zone, the first and second mirrors converging towards the slot. The slot is open both on the side of the front face of the mirror and on the side of the rear face 19 of the housing box, this rear face 19 being positioned to be opposite the front face 17. In the example shown, the first and second mirrors 11 and 13 form an angle of 90° relative to each other.

The forward direction here corresponds to the direction of propagation of the reflected beam. The rearward direction is the opposite of the forward direction.

In the example represented in FIG. 1, the emitter 3 is a thin plate made from piezoelectric crystal. It includes an intermediate portion 21 engaged in the slot 15, a front part 23 protruding forwards towards the front out of the slot 15, a rear part 25 protruding out of the slot 15, towards the rear. The emitter 3 has first and second large surfaces 27, 29, positioned to be opposite one another. The zones of the first and second large surfaces 27, 29 delimiting the front part 23 of the emitter constitute the first and second emitting surfaces 7 and 9. The first and second emitting surfaces 7 and 9 therefore form an angle of 45° with the first and second mirrors 11 and 13.

The emitter 3 is attached to the housing box 5 by cooperation of form between the portion 21 and the slot 15 or by means of bonding of the portion 21 within the interior of the slot 15.

The functioning of the ultrasound transducer is as follows.

The first and second emitting surfaces 7, 9 emit the first and second ultrasound beams F1 and F2 that are propagated along the first and second directions of propagation. The first and second directions of propagation are substantially perpendicular to the surfaces 7 and 9. They form an angle of 45° in relation to the normals of the first and second mirrors 11 and 13. The first and second ultrasound beams are reflected on the first and second mirrors 11 and 13 and form a reflected beam FR. The first and second ultrasound beams are reflected at 90°, in the direction wherein the direction of propagation of the reflected beam is at 90° from the first and second directions of propagation, as is shown by the arrows in FIG. 1.

A variant of the embodiment of the invention will now be described with reference to the FIG. 2. Only the points whereby this variant embodiment differs from the one shown in FIG. 1 will be detailed here below.

Figure 2:
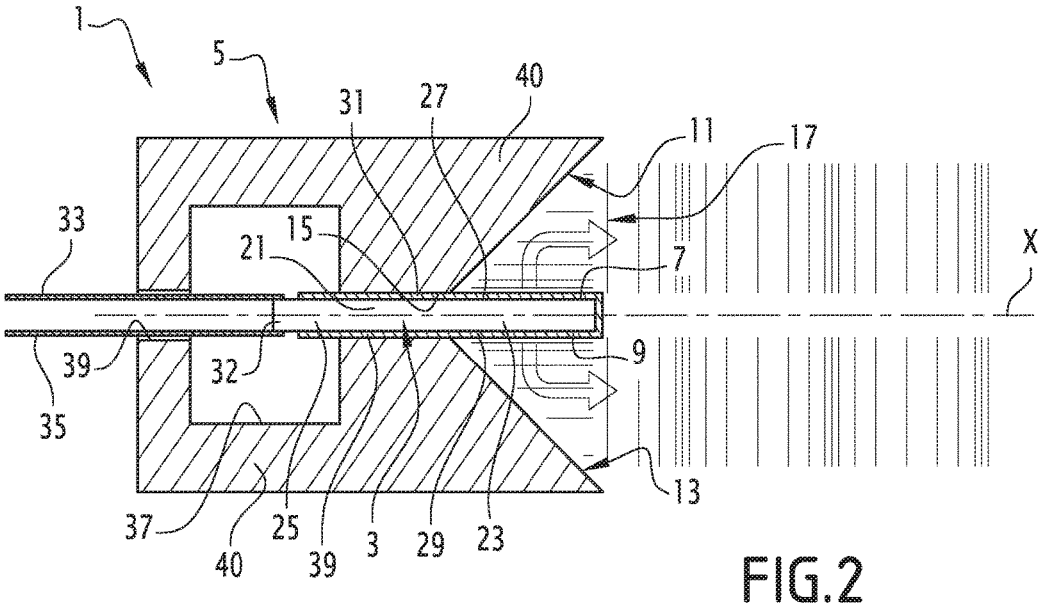
FIG. 2 is a view that is similar to that of FIG. 1, showing variants of the embodiment of the invention.

As is visible in FIG. 2, the transducer includes a protective layer 31 covering the emitter. The protective layer is made of an elastomeric material. It covers the first and second emitting surfaces 7 and 9. It also covers the two large surfaces 27 and 29, almost in their entirety. In particular, the layer 31 is interposed between the intermediate portion 21 and the edge of the slot 15. On the other hand, the layer 31 does not cover a rear edge 32 of the emitter 3.

In addition, the transducer 1 includes electrical wires 33, 35, connected to a voltage source that has not been represented. The electrical wires 33 and 35 are pressed flat respectively against the first and second large surfaces 27, 29 of the emitter 3, at the level of the rear edge 32. As the latter is not covered by the protective layer 31, it is thus possible for electrical contact to be made between the electrical wires 33 and 35 and emitter. The electrical wires 33 and 35 are maintained in position by a clamp that is not represented. They are not soldered to the emitter.

The rear part 25 of the emitter is housed in a recessed cavity 37 provided in the housing box 5. This part, as well as the connections between the electrical wires 33 and 35 and the rear edge 32, are thus protected from aggressive external or environmental elements. The housing box 5 has an orifice 39, which brings about communication between the cavity 37 and the exterior. The electrical wires 33 and 35 come out of the housing box through the orifice 39.

The housing box 5 consists of two half housing boxes 40 between which is clamped the emitter 3. Each half housing box 40 defines one of the first and second mirrors 11, 13. The slot 15 is delimited between the two half housing boxes 40. The half housing boxes 40 are attached to one another by any appropriate means: screws, soldering, etc.

Figure 3:
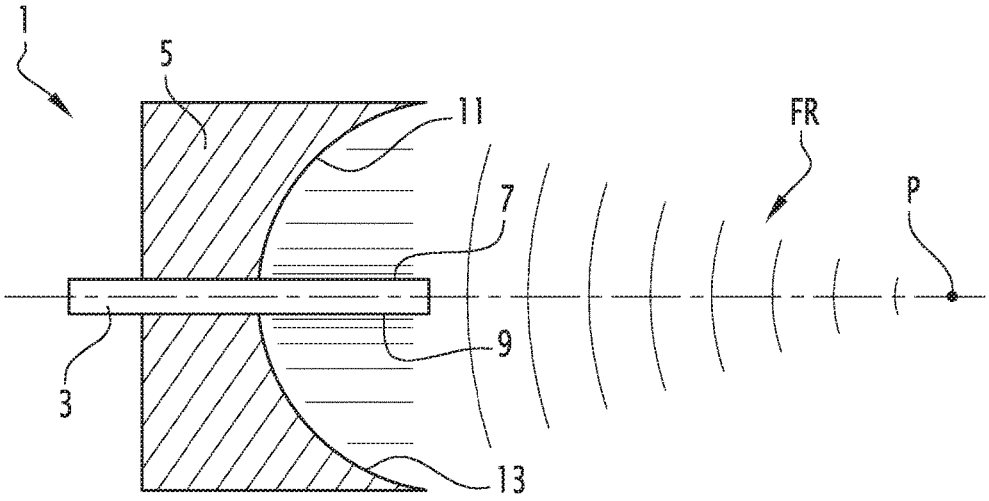
FIG. 3 and FIG. 4 are views that are similar to those of FIG. 1, showing variants of shape and form for the mirrors of the transducer; and the FIGS. 5 and 6 are views that are similar to those of FIG. 2, illustrating another aspect of the invention.
Figure 4:
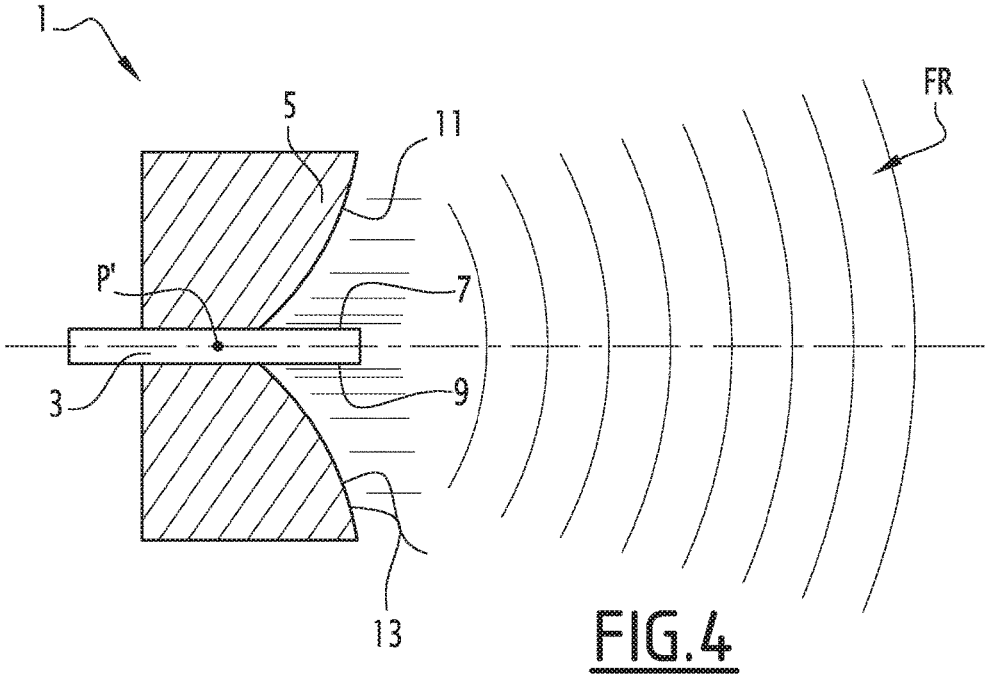

The FIGS. 3 and 4 represent two variants of embodiment of the invention, in which the mirrors 11 and 13 are not planar.

In FIG. 3, the mirrors 11 and 13 are concave towards the first and second emitting surfaces 7 and 9. The concavity is calculated so as to ensure that the reflected beam has a concentric wave front. The reflected beam FR is then focused on a point P, situated at a distance toward the front of the emitter.

In FIG. 4, the first and second mirrors 11 and 13 are convex towards the first and second emitting surfaces 7 and 9. The first and second mirrors 11 and 13 are arranged so as to ensure that the reflected beam has a diverging wave front.

Figure 5:
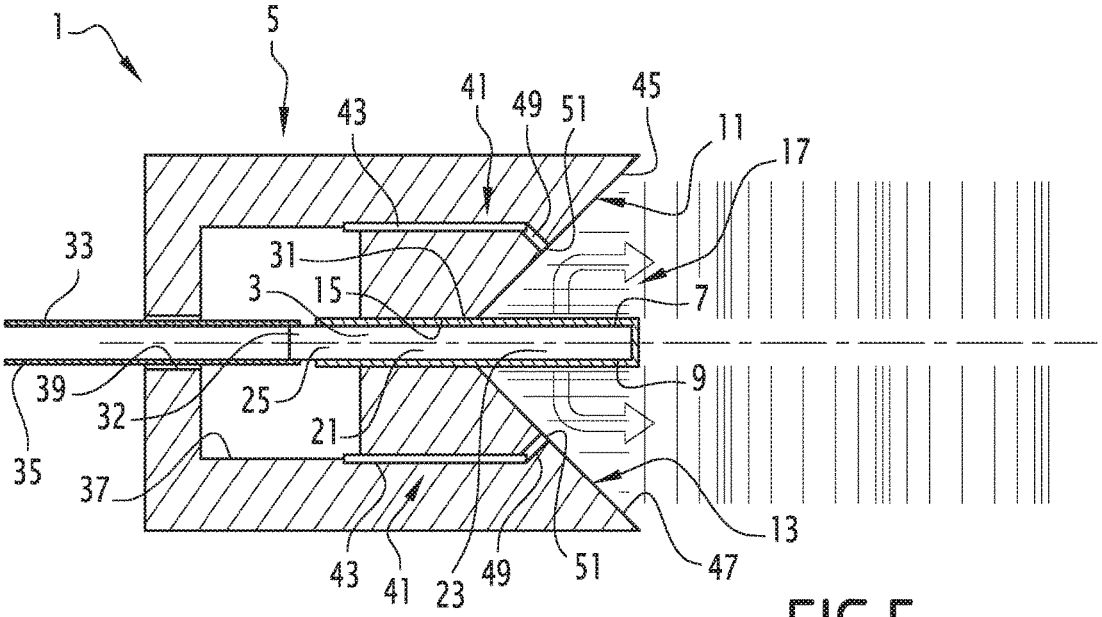
Figure 6:
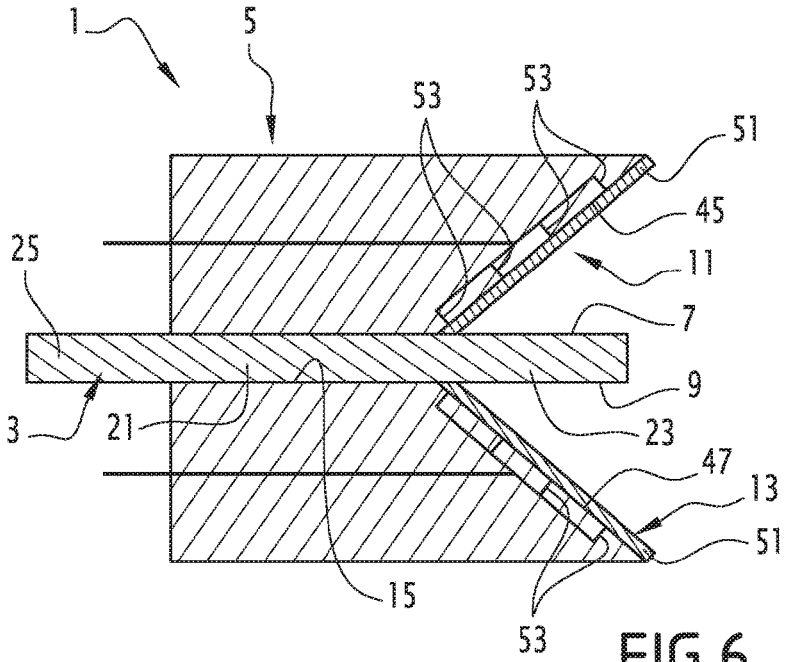

A second aspect of the invention will now be detailed, in reference to the FIGS. 5 and 6. Only the points whereby the transducers shown in the FIGS. 5 and 6 differ from those shown in the FIGS. 2 and 1 respectively will be detailed here below. The elements that are identical or that provide the same function in the FIGS. 2 and 1 as in the FIGS. 5 and 6 shall be denoted by the same reference numerals.

In the examples of embodiment shown in the FIGS. 5 and 6, the transducer 1 includes at least one sensor 41 provided in order to measure the shape or intensity of the ultrasonic waves. This sensor 41 is arranged in one of the first and second mirrors.

In the example shown in FIG. 5, the transducer includes two identical sensors 41, arranged so as to locate one in the first mirror 11 and the other in the second mirror 13.

The housing box 5 includes two channels 43, opening out on one side in the cavity 37 and on the other side, on to the first and second reflective surfaces 45 and 47 of the first and second mirrors. Each sensor 41 has a head 49 made of a piezoelectric crystal, engaged in the channel 43. The head 49 is positioned to be flush with the first or second reflecting surface. The sensor, more precisely, is the head 49 of the sensor, and is thus flush with the first or the second reflecting surface. The head 49 presents a free surface 51, which forms an integral part of the continuity of the reflecting surface 45 or 47.

Each sensor 41 further includes at least one electrical power line (not shown) electrically connected to the head 49. This line traverses through the channel 43, leads out into the cavity 47 and exits out of the housing box through the orifice 39. It is connected for example to a computing unit.

In the variant of embodiment shown in FIG. 6, each sensor 41 comprises a thin layer 51 of a piezoelectric crystal, covering the first or the second mirror 11, 13. Each sensor 41 also includes a plurality of electrodes 53 electrically connected to different points of the thin layer 51. These electrodes 53 are connected by electrical wires to a computing unit. The thin layer 51 covers the entire reflective surface 45, 47, of the first and second mirrors. Thus, it is possible to control the shape of the ultrasonic signal emitted by different zones of the mirror.

A variant of the embodiment of the invention will now be described with reference to FIG. 7. Only the points whereby this variant embodiment differs from the one shown in FIG. 1 will be detailed here below.

In the variant of the embodiment shown in FIG. 1, the transducer 1 is intended to be immersed in an ambient medium such as water. The first and second emitting surfaces 7, 9 are arranged in relation to the housing box 5 in order to ensure that the first and second ultrasound beams F1, F2 are propagated from the first and second emitting surfaces 7, 9 right up to the first and second mirrors 11, 13 through the ambient medium.

The reflected beam FR is transmitted by the ambient medium to the piece in which the ultrasonic wave is transmitted.

Figure 7:
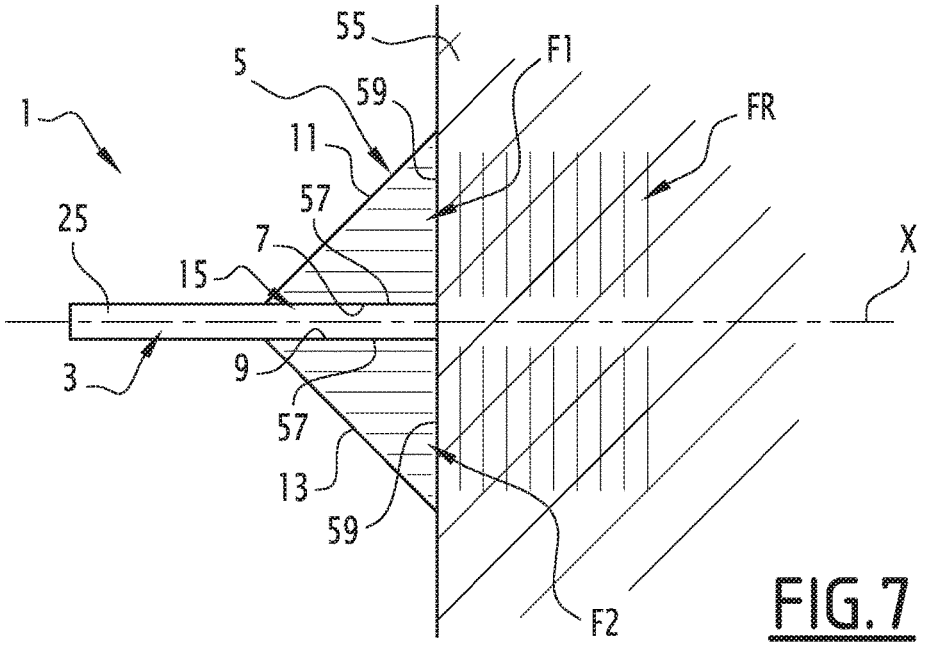
FIGS. 7 and 8 are views that are similar to those of FIG. 1, showing yet other variants of the embodiment of the invention.

In the variant of the embodiment shown in FIG. 7, the transducer 1 is capable of sending the reflected beam FR directly into the piece in which the ultrasonic wave is transmitted 55, without the transmission taking place through the ambient medium.

To this end, the first and second emitting surfaces 7, 9 are arranged in relation to the housing box 5 in order to ensure that the first and second ultrasound beams F1, F2 are propagated from the first and second emitting surfaces 7, 9 right up to the first and second mirrors 11, 13 through the material constituting the housing box 5.

Figure 8:
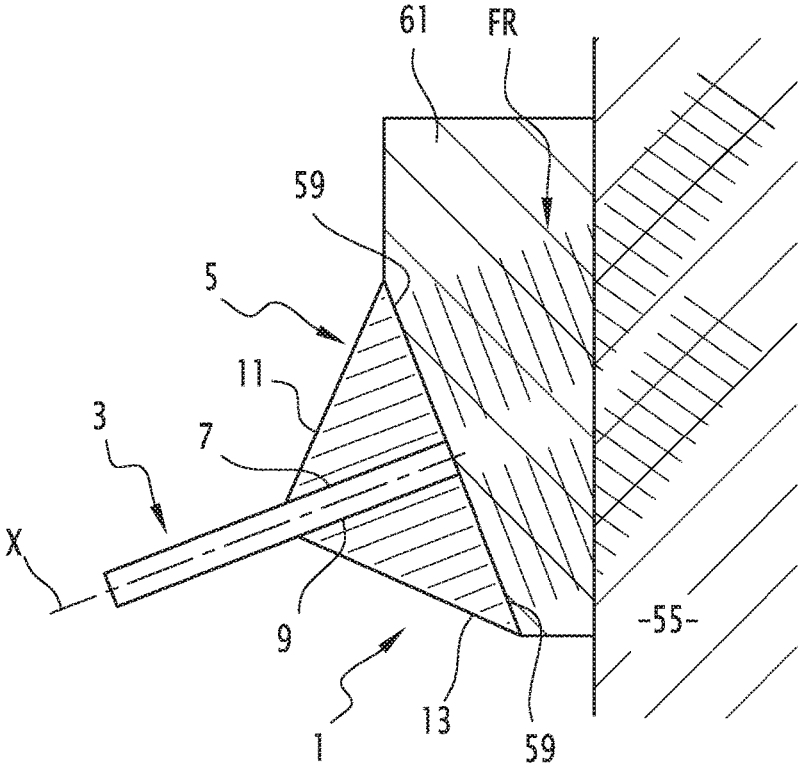

The first and second emitting surfaces 7, 9 of the emitter 3 are then pressed flat against the wave input surfaces 57 of the housing box. In the example represented, the wave input surfaces 57 delimit the slot 15 in which the emitter 3 is engaged. The wave output surfaces 59 of the housing box 5 are pressed flat against the piece in which the ultrasonic wave is transmitted 55. In the example represented, the wave output surfaces 59 are pressed flat directly against the piece 55. In a variant represented in FIG. 8, a wedge 61 is interposed between the wave output surfaces 59 and the piece 55. The wedge for example makes it possible to adjust the direction of propagation of the ultrasonic beam in the piece in which the ultrasonic wave is transmitted.

By way of a variant, the housing box 5 and the wedge 61 are integrally formed as a single unit and constitute one same piece. The mirrors are therefore somewhat longer (they exceed the extreme end point of the emitter) and directly incorporate the angle in order to cause deflection of the ultrasound beam in the piece (below the critical angle).

The first and second mirrors 11, 13, the wave input surfaces 57 and the wave output surfaces 59 are arranged in order to ensure that the first and second ultrasound beams F1, F2 penetrating into the housing box 5 through the input surfaces 57 are reflected by the first and second mirrors 11, 13 right to the output surfaces 59. The reflected beam FR is propagated in the interior of the housing box 5, exits the housing box 5 through the output surfaces 59 and penetrates into the piece in which the ultrasonic wave is transmitted 55.

What is claimed is:

1. An ultrasound transducer comprising:

at least one emitter made from a material configured to convert an electrical signal into an ultrasonic wave, the at least one emitter having first and second emitting surfaces opposite one another provided to emit first and second ultrasound beams;

at least first and second mirrors placed so as to be across from the first and second emitting surfaces, respectively, and configured in a manner such as to deflect back the first and second ultrasound beams by forming a reflected beam with a predetermined shape; and a housing box to which the emitter is attached, the housing box being integrally formed as a single piece or comprises of two half housing boxes encasing the emitter therebetween.

2. The ultrasound transducer as recited in claim 1 wherein the housing box has two reflective surfaces defining the first and second mirrors, or the first and second mirrors are attached on to the housing box.

3. The ultrasound transducer as recited in claim 1 wherein the housing box has a slot in which the emitter is engaged, the slot having a cross section that is substantially identical to that of the emitter.

4. The ultrasound transducer as recited in claim 1 wherein each half housing box defines one of the first and second mirrors, or the first mirror is attached on to one of the two half housing boxes and the second mirror is attached on to the other of the two half housing boxes.

5. The ultrasound transducer as recited in claim 1 wherein the transducer is immersed in an ambient medium, with the first and second emitting surfaces being arranged in relation to the housing box in order to ensure that the first and second ultrasound beams are propagated from the first and second emitting surfaces right up to the first and second mirrors through the ambient medium or through a material constituting the housing box.

6. The ultrasound transducer as recited in claim 1 further comprising electrical wires that are able to be connected to a voltage source, and a clamp that clamps the electrical wires against the emitter in a manner so as to secure the electrical wiring to the emitter without soldering.

7. The ultrasound transducer as recited in claim 1 further comprising a protective layer covering the first and second emitting surfaces.

8. The ultrasound transducer as recited in claim 1 wherein the first and second ultrasound beams present first and second directions of propagation from the first and second emitting surfaces, the first and second mirrors being planar and having first and second normals forming an angle comprised between 30° and 60° in relation to the first and second directions of propagation.

9. The ultrasound transducer as recited in claim 1 wherein the first and second mirrors are concave to the first and second emitting surfaces.

10. The ultrasound transducer as recited in claim 1 wherein the first and second mirrors are convex to the first and second emitting surfaces.

11. The ultrasound transducer as recited in claim 1 wherein the emitter is a plate, with the first and second emitting surfaces being two large parallel surfaces of the plate that are positioned opposite one other.

12. The ultrasound transducer as recited in claim 1 wherein the emitter is a cylinder or a tube that is radially polarized, with the first and second emitting surfaces being two radial surfaces that are diametrically opposed.

13. The ultrasound transducer as recited in claim 1 further comprising at least one electroacoustic transducer, arranged in one of the first and second mirrors.

14. The ultrasound transducer as recited in claim 13 wherein the first and second mirrors present first and second reflective surfaces, the electroacoustic transducer being positioned to be flush with one of the first and second reflective surfaces.

15. The ultrasound transducer as recited in claim 13 wherein the electroacoustic transducer includes a head made from a piezoelectric crystal.

16. The ultrasound transducer as recited in claim 13 wherein the electroacoustic transducer includes a thin layer of a material that is configured to convert an ultrasonic wave into electrical voltage covering one of the first and second mirrors.

17. The ultrasound transducer as recited in claim 16 wherein the thin layer of material is a piezoelectric crystal.

* * * * *